US005169603A

United States Patent [19]

Landsberger

[11] Patent Number: 5,169,603

[45] **Date of Patent: * Dec. 8, 1992**

[54] MODULAR TEST TUBE RACK ARRANGEMENT

[76] Inventor: David Landsberger, 52 Washburn Pl., Caldwell, N.J. 07006

[ * ] Notice: The portion of the term of this patent subsequent to Dec. 31, 2008 has been disclaimed.

[21] Appl. No.: 739,164

[22] Filed: Aug. 1, 1991

[51] Int. Cl.[5] ..... B01L 9/06

[52] U.S. Cl. ..... 422/104; 211/74

[58] Field of Search ..... 422/104, 300, 297; 211/74, 71

[56] References Cited

U.S. PATENT DOCUMENTS

| | | | |
|---|---|---|---|
| 134,738 | 8/1873 | Dudley | 211/74 |
| 1,270,095 | 6/1918 | Baehr | 211/74 |
| 1,283,389 | 10/1918 | Wills et al. | 211/74 |
| 3,379,315 | 4/1968 | Broadwin | 211/74 |
| 3,606,023 | 9/1971 | Edmunds | 211/74 |
| 4,988,003 | 1/1991 | Spitzer et al. | 211/71 |
| 5,020,755 | 6/1991 | Frankel | 211/74 |
| 5,025,936 | 6/1991 | Lamoureaux | 211/74 |
| 5,076,445 | 12/1991 | Landsberger | 211/74 |

*Primary Examiner*—Lynn M. Kummert
*Assistant Examiner*—Hien Tran
*Attorney, Agent, or Firm*—Anthony F. Cuoco

[57] ABSTRACT

A plurality of test tube racks are disposed side by side and coupled together at their opposite sides via clamps to form a modular test tube rack arrangement. A handle or handles engage(s) the clamps to provide a balanced pivot handle arrangement for transporting a modular set of connected racks.

15 Claims, 4 Drawing Sheets

MODULAR TEST TUBE RACK ARRANGEMENT

BACKGROUND OF THE INVENTION

This invention relates to modular test tube racks and particularly to an arrangement wherein a plurality of test tube racks are arranged in a modular set. More particularly, this invention relates to an arrangement of the type described wherein the test tube racks are clamped together in side by side relation to provide the modular set.

Test tube racks are basic equipment in laboratories and the like and serve to hold test tubes during various analytical and processing procedures. In this regard, and for purposes of illustration, reference is made to catalogue 283 published by Bel-Art Products, Inc., Pequannock, N.J., wherein a variety of test tube racks are illustrated and described.

It is desirable to have a set of racks arranged in modular fashion so that a plurality of racks so arranged can be handled as a single rack. It will be recognized that this is advantageous when dealing with a multiplicity of test tubes, especially when various tube/rack sizes are required. It is also desirable in an arrangement of the type described to have a handle which can be connected to the modular arrangement, to provide a balanced pivot handle for a set of racks so arranged. This allows the modular set of racks to be self-transportable, eliminating trays and other handling devices as might otherwise be necessary.

SUMMARY OF THE INVENTION

This invention contemplates a modular test tube rack arrangement wherein a plurality of test tube racks are clamped together in side by side relation to form a modular set. In a preferred embodiment of the invention, each of the racks includes a base and a pair of sides which are substantially normal to the base and which support upper and lower test tube support members.

Clamps are provided whereby a side of one test tube rack is clamped to a side of another test tube rack to form a modular set of test tube racks. The clamps are adapted to support a handle member or members for providing a balanced pivot handle arrangement for the modular set for easily transporting said modular set and thereby eliminating trays and other handling and transporting devices.

DETAILED DESCRIPTION OF THE INVENTION

Figure 1:
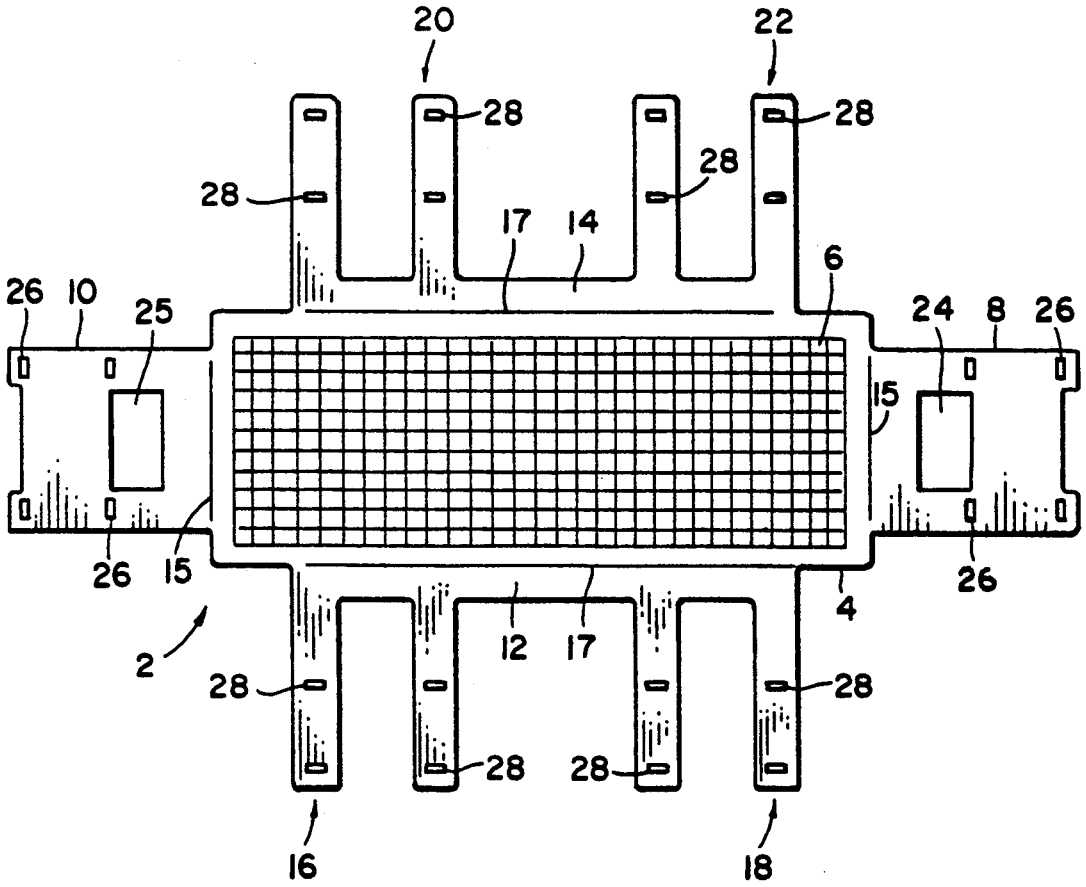
FIG. 1 is a plan view of a base for a test tube rack of the type contemplated in the preferred embodiment of the invention.
Figure 2:
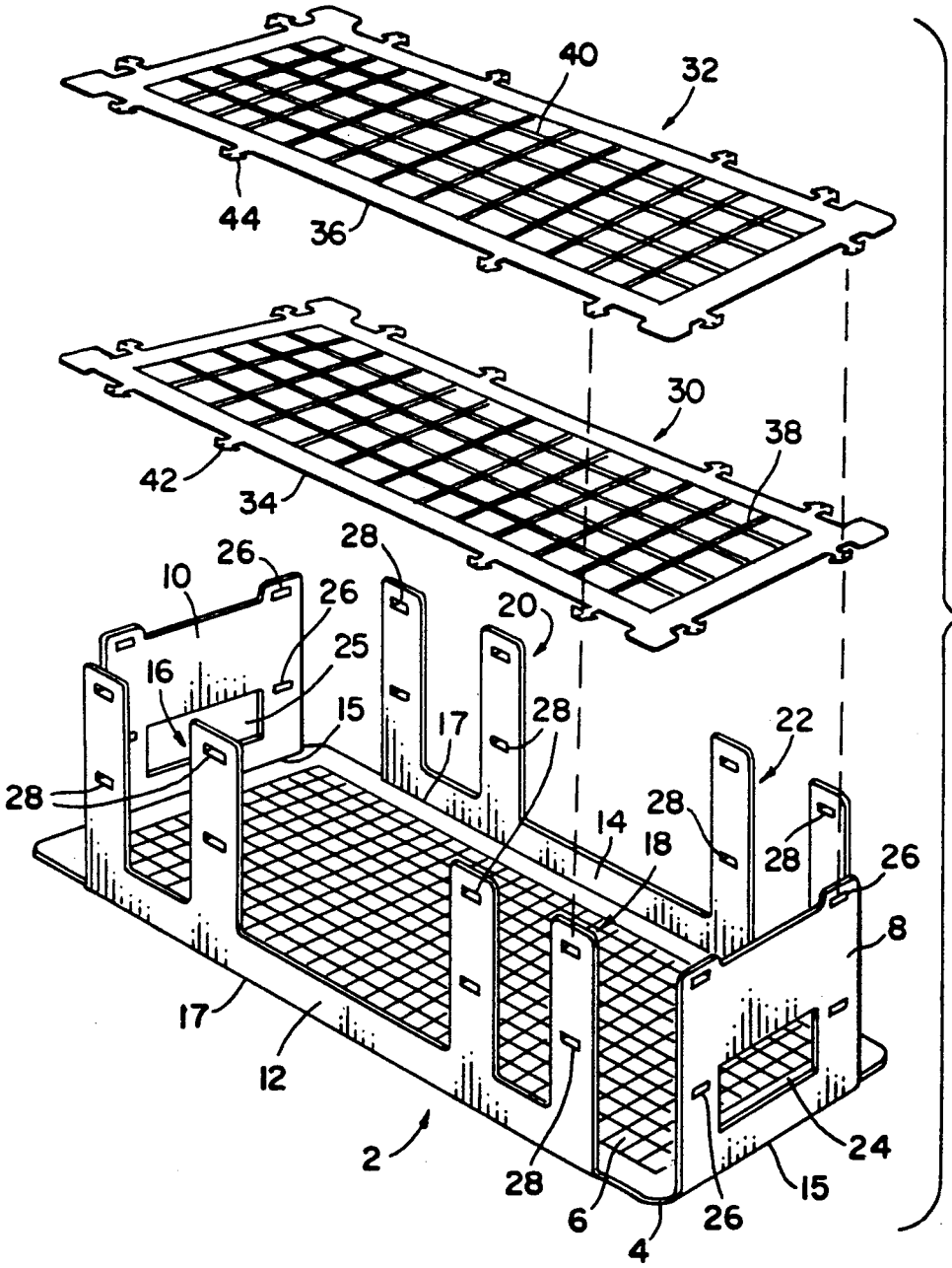
FIG. 2 is an exploded view showing the sides and ends of the base shown in FIG. 1 bent normal to the bottom thereof and further showing upper and lower test tube support members according to the invention.

With reference to FIGS. 1 and 2, wherein a test tube rack in accordance with a preferred embodiment of the invention is shown. A test tube rack base is designated by the numeral 2. Base 2 has a solid circumferential frame 4 surrounding an open grid 6 which serves as the bottom of the base as will hereinafter become evident.

End members 8 and 10 extend from the one and the opposite ends of frame 4 and side members 12 and 14 extend from the one and the opposite sides of said frame. Side members 12 and 14 each include a pair of U-shaped support members 16 and 18 and 20 and 22, respectively. U-shaped members 16 and 18 are in spaced relation and are disposed near the ends of side member 12 and U-shaped members 20 and 22 are in corresponding spaced relation and are disposed near the ends of side member 14.

End members 8 and 10 have substantially rectangular relatively large openings 24 and 25, respectively, extending therethrough for purposes which will be hereinafter described.

End members 8 and 10 have a plurality (shown as four in number for illustration purposes) of horizontally and vertically aligned relatively small, substantially rectangular, discretely spaced upper and lower apertures such as 26. U-shaped members 16 and 18 of side member 12 and 20 and 22 of side member 14 likewise have a plurality (shown as four in number for illustration purposes) of horizontally and vertically aligned relatively small, discretely spaced substantially rectangular, upper and lower apertures such as 28. Apertures 26 and 28 have a purpose which will be hereinafter described.

With particular reference to FIG. 1, base 2 is molded as a flat member of a suitable plastic material such as polypropylene with a ten percent talc content for weighting purposes. In forming the test tube rack, ends 8 and 10 and sides 12 and 14 are bent so as to be substantially normal to bottom 6 as shown in FIG. 2. In this regard it will be understood that ends 8 and 10 and sides 12 and 14 extend from base frame 4 so as to form a natural hinge therewith as at 15 and 17, whereby the aforenoted bending is facilitated as is well known in the plastics fabrication art.

With reference to FIG. 2, a lower test tube support member is designated by the numeral 30 and an upper test tube support member is designated by the numeral 32. Support members 30 and 32 include solid circumferential frames 34 and 36, respectively, surrounding open grids 38 and 40, respectively. The size and pattern of grid 38 and the size and pattern of grid 40 must coincide as will be hereinafter more fully explained.

Frame 34 has a plurality of shouldered tabs 42 spaced circumferentially therearound and frame 40 has a corresponding plurality of like tabs 44 likewise spaced circumferentially therearound. Tabs 42 and 44 are spaced so as to correspond to the spacing of lower and upper apertures 26 in base end members 8 and 10, respectively and lower and upper apertures 28 in base side members 12 and 14, respectively.

As particularly shown in FIG. 2, in providing the test tube rack assembly of the invention, lower test tube support member 30 is disposed between base end members 8 and 10 and base side members 12 and 14 so that tabs 42 are aligned with lower apertures 26 and 28. Thereupon tabs 42 are snapped into said apertures 26 and 28 so that lower support member 38 is supported on its ends and sides by the ends and sides of base 2. Similarly, upper test tube support member 32 is disposed between base end members 8 and 10 and side members 12 and 14 so that tabs 44 are aligned with upper apertures 26 and 28, whereupon said tabs are snapped into said apertures so that upper support member 40 is supported on its ends and sides by base 2 above lower support member 30.

As heretofore noted, the spacing and pattern of lower and upper support member grids 38 and 40 must correspond so that test tubes to be supported thereby are axially displaced first through upper support member grid 40 and then through lower support member grid 38. The spacing and pattern of base grid 6 need not correspond to that of grids 38 and 40 since the purpose of grid 6 is merely for draining or the like as will now be understood by those skilled in the art.

Openings 24 and 25 in end members 8 and 10 of base 2 are for handling purposes, whereby the rack assembly can be easily grasped.

It will now be understood that with base member 2 provided as aforenoted, support members 38 and 40 may be interchangeably assembled to the base member. Thus, it may be desirable to stock a plurality of pairs of lower and upper support members such as 38 and 40, each pair having a different but corresponding grid spacing and pattern to support more or less test tubes of larger or smaller sizes, as the case may be.

In further description of the invention it will be understood that the described assembly features ease of manufacture and maximum versatility. Further, the fabrication of the invention, which in the preferred embodiment thereof is of a molded plastic construction as aforenoted, is simplified. Thus, base 2, lower support members 38 and upper support member 40 may be molded as flat members to reduce mold costs. Further, these members may be stored and shipped in the flat state to reduce required storage space and shipping costs as will now be understood. A single base 2 may be used with a variety of sizes and quantities of test tubes. The test tube rack as described is easily cleaned and is readily autoclavable as is desirable.

Figure 3:
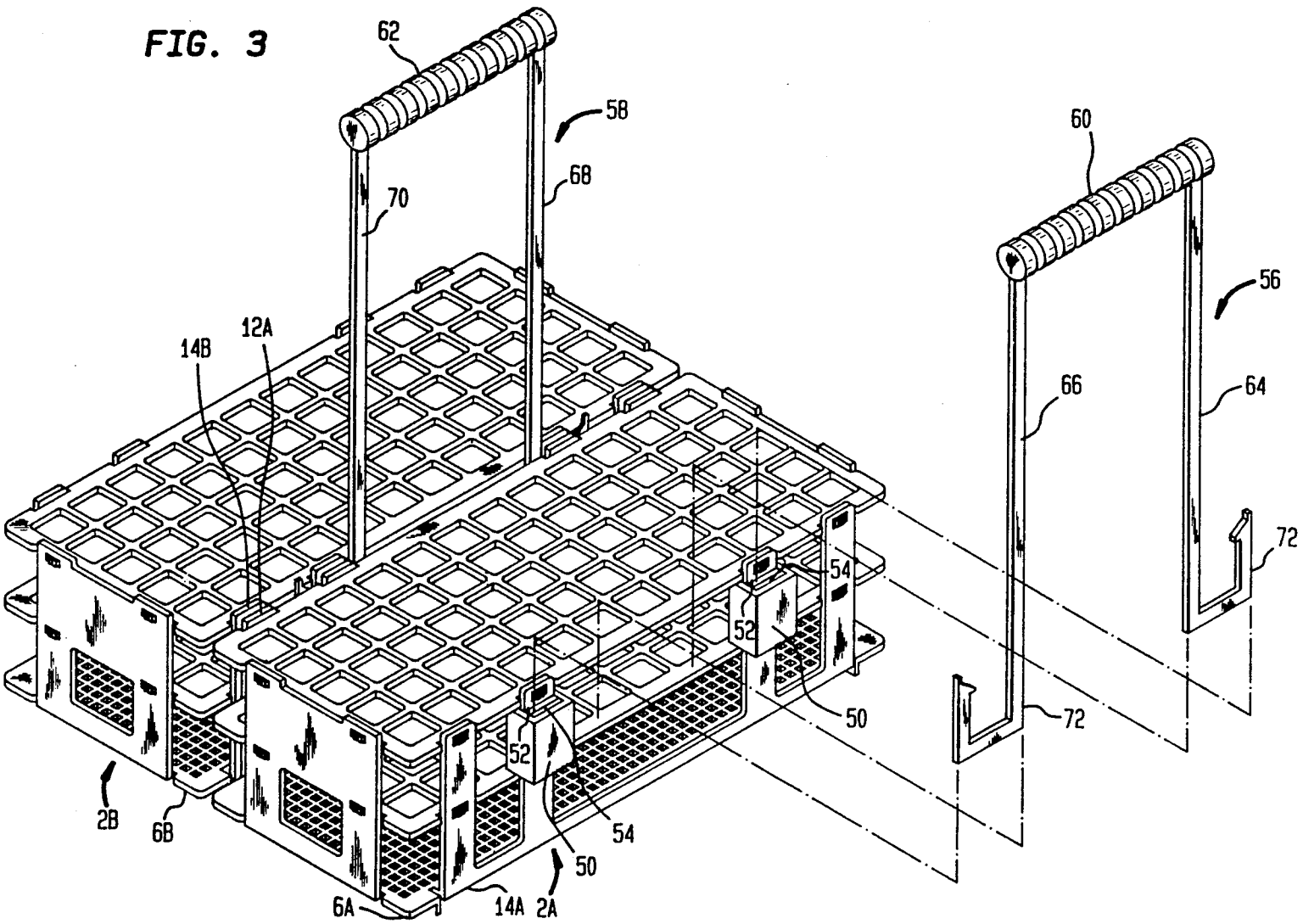
FIG. 3 is an elongated view showing a pair of test tube racks arranged as a modular set and showing clamps for securing the racks in said arrangement, and further showing handle members for supporting the modular set in accordance with the invention.

With reference to FIG. 3, a pair of test tube racks such as rack 2 are designated as 2A and 2B. Racks 2A and 2B are disposed side by side so that their opposite side members 12A and 14B, respectively, are parallel and near one another. Although only two such test tube racks are shown for purposes of illustrating the invention, it will be recognized that a plurality of such racks, each with their opposite side members disposed as described, may be arranged in a modular set, the same being within the scope of the invention.

With continued reference to FIG. 3, side members 12A and 14B, and the other side and end members of racks 2A and 2B are bent so as to be substantially normal to their respective bases 6A and 6B. The test tube racks are assembled via tabs and apertures as heretofore described with reference to FIG. 1.

Figure 4:
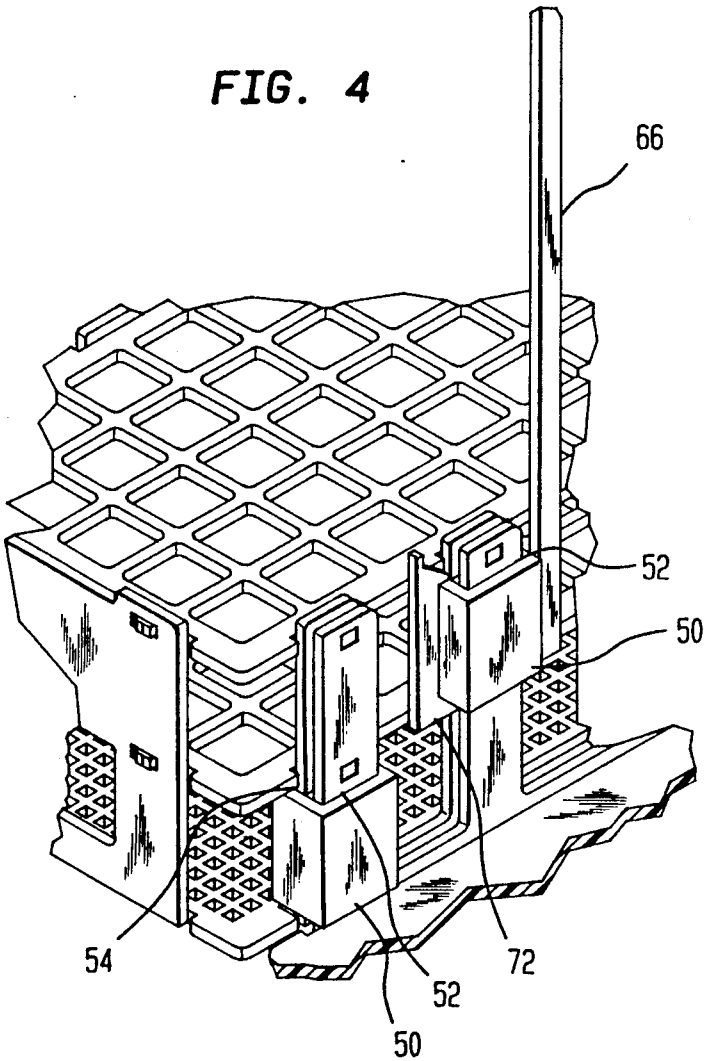
FIG. 4 is a perspective view particularly showing a handle member and clamps in accordance with the invention.

A pair of clamping members, each of which is designated by the numeral 50, are shown in FIGS. 3 and 4. Clamping members 50 are substantially rectilinear in shape and have a pair of parallel transversely spaced slots 52 and 54 extending therethrough. One of the slots 52 and 54 receives one of the legs of a U-shaped member such as 16, 18, 20, 22 (FIG. 1) on one of the test tube rack sides such as 12A and the other of the slots receives a corresponding leg of a U-shaped member such as 16, 18, 20, 22 on an opposite test tube rack side such as 14B. Thus, a plurality of test tube racks may be arranged in a modular set with the opposite sides of successive racks in the set being disposed parallel to and near each other and clamped together via clamps 50.

With further reference to FIG. 3, it will be recognized that sides 12A and 14B of racks 2A and 2B, respectively, are so arranged with a pair of clamping members 50 (not shown). Another pair of clamping members 50 is assembled to side 14A of rack 2A as heretofore described in readiness for receiving in modular configuration another test tube rack, as will now be understood.

In assembling or disassembling the modular configuration of test tube racks, it is necessary to disengage the respective side members of the racks by removing tabs 42 from apertures 28 (FIG. 1), so as to bend the side members away from a normal orientation from the rack base. With the sides thus bent, the respective legs of the U-shaped members are inserted in or removed from the clamping member slots and thereafter tabs 44 are reengaged with apertures 26.

It will be recognized that clamping members 50 may be disposed at various heights along the U-shaped member leg as illustrated in FIG. 4. In the preferred embodiment of the invention, the clamping members are disposed near the top of the test tube rack as particularly shown in FIG. 3. Likewise, the clamping members may be disposed on the outer legs of the U-shaped members, or the inner legs as shown in FIG. 3, and indeed may be disposed on both inner and outer legs as shown in FIG. 4, as the case may be. The number of clamps used depends on the degree of clamping rigidity desired.

With continued reference to FIG. 3, a pair of handle members 56 and 58 are illustrated. Handle members 56 and 58 each have hand gripping portions 60 and 62, respectively, and a pair of longitudinally extending rod members 64, 66 and 68, 70, respectively. Rod members 64, 66 and 68, 70 are in spaced relation, and which spaced relation corresponds generally to the spaced relation of the legs of the aforementioned U-shaped members received by the clamps.

Rod members 64, 66 and 68, 70 of handle members 56 and 58, respectively, terminate in hook members such as 72 shown in FIGS. 3 and 4. The arrangement is such that the rod members fit between the sides of the racks clamped together via clamping members 50 as heretofore described, with the hook members engaging the bottom of the clamps and snapping onto the top thereof. This configuration is particularly illustrated in FIG. 4.

In this fashion, a plurality of handle members such as 56 and 58 may be disposed along a length of test tube racks to provide a balanced handle arrangement for a modular set of clamped racks, thereby allowing the set of racks to be equipped with their own transport arrangement for eliminating trays and other handling devices as might otherwise be necessary.

In this regard it will be understood that the handle rod members are of a suitable flexible plastic material and may be easily disengaged from clamping members 50 as by manipulating a handle member downwardly off of and away from a clamping member, and thereafter manipulating the disengaged handle members upwardly between the clamped sides of the racks. A handle member may likewise engage the clamping members by manipulating the handle member downwardly between the clamped rack sides so that the hook members thereof engage and snap onto the clamping members.

There has thus been described a modular test tube rack arrangement which features a plurality of test tube racks having opposite sides disposed near one another, with said opposite sides being clamped together. The arrangement allows a modular set of racks to be formed and handled via a balanced arrangement of handle members as a single rack. This is particularly advantageous when dealing with a multiplicity of test tubes, and especially when various tube/rack sizes are required.

With the above description of the invention in mind, reference is made to the claims appended hereto for a definition of the scope of the invention.

What is claimed is:

1. A modular test tube rack arrangement, comprising:

a plurality of test tube racks, each of which includes a flat base and side members extending in a natural hinge arrangement therefrom so as to be bent substantially normal to the base, the side members each including a plurality of support members disposed therealong in spaced relation;

said plurality of racks being disposed side by side so that one side member of one rack is disposed parallel to and in spaced relation to an opposite side member of an other rack; and clamping means clamped to at least two support members of the one side member of the one rack and to corresponding support members of the opposite side member of the other rack, whereby the plurality of racks are clamped together in a modular set.

2. The modular test tube rack arrangement as described by claim 1, wherein the clamping means includes:

a plurality of clamps, each of which is rectilinear in shape and has a pair of parallel, transversely spaced slots extending therethrough;

a support member of the one side member received by one of the pair of slots and a corresponding support member of the other side member being received by the other of the pair of slots.

3. The modular test tube rack arrangement as described by claim 2, wherein:

the support members have bottoms; and the pairs of slots in the clamps receive the bottoms of the support members.

4. The modular test tube rack arrangement as described by claim 2, wherein:

the support members have tops; and the pairs of slots in the clamps receive the tops of the support members.

5. The modular test tube rack as described by claim 2, including:

a plurality of handle members, each of which includes a hand gripping portion and a pair of rod members extending downwardly therefrom in spaced relation corresponding to the spaced relation of the support members received by the pairs of slots in the clamps;

each of said rod members terminating in a hook; and a handle member of the plurality of handle members being disposed between the one and the opposite sides of each of a pair of clamped racks, and being manipulated so that the hooks engage the clamps.

6. A modular test tube rack arrangement comprising:

a plurality of test tube racks, each of which has one side member and an opposite side member, each of the side members having a plurality of support members disposed therealong in spaced relation;

said plurality of racks being disposed side by side so that the one side member of one rack is disposed parallel to and in spaced relation to the opposite side member of an other rack; and clamping means clamped to at least two support members of the one side member of the one rack and to corresponding support members of the opposite side member of the other rack, whereby the plurality of racks are clamped together in a modular set.

7. The modular test tube rack arrangement as described by claim 6, wherein the clamping means includes:

a plurality of clamps, each of which is rectilinear in shape and has a pair of parallel, transversely spaced slots extending therethrough;

a support member of the one side member received by one of the pair of slots and a corresponding support member of the other side member being received by the other of the pair of slots.

8. The modular test tube rack arrangement as described by claim 7, wherein:

the support members have bottoms; and the pairs of slots in the clamps receive the bottoms of the support members.

9. The modular test tube rack arrangement as described by claim 7, wherein:

the support members have tops; and the pairs of slots in the clamps receive the tops of the support members.

10. The modular test tube rack as described by claim 7, including:

a plurality of handle members, each of which includes a hand gripping portion and a pair of rod members extending downwardly therefrom in spaced relation corresponding to the spaced relation of the support members received by the pairs of slots in the clamps;

each of said rod members terminating in a hook; and a handle member of the plurality of handle members being disposed between the one and the opposite sides of each of a pair of clamped racks, and being manipulated so that the hooks engage the clamps.

11. In an improved modular test tube rack arrangement of the type in which a plurality of test tube racks, each having one side member and an opposite side member, and each of the side members having a plurality of support members disposed therealong in spaced relation, wherein the improvement comprises:

said plurality of racks being disposed side by side so that the one side member of one rack is disposed parallel to and in spaced relation to the opposite side member of an other rack; and clamping means clamped to at least two support members of the one side member of the one rack and to corresponding support members of the opposite side member of the other rack, whereby the plurality of racks are clamped together in a modular set.

12. The improved modular test tube rack arrangement as described by claim 11, wherein the clamping means includes:

a plurality of clamps, each of which is rectilinear in shape and has a pair of parallel, transversely spaced slots extending therethrough;

a support member of the one side member received by one of the pair of slots and a corresponding support member of the other side member received by the other of the pair of slots.

13. The improved modular test tube rack arrangement as described by claim 12, wherein:

the support members have bottoms; and the pairs of slots in the clamps receive the bottoms of the support members.

14. The improved modular test tube rack arrangement as described by claim 12, wherein:

the support members have tops; and the pairs of slots in the clamps receive the tops of the support members.

15. The improved modular test tube rack as described by claim 12, including:

a plurality of handle members, each of which includes a hand gripping portion and a pair of rod members extending downwardly therefrom in spaced relation corresponding to the spaced relation of the support members received by the pairs of slots in the clamps;

each of said rod members terminating in a hook; and a handle member of the plurality of handle members being disposed between the one and the opposite sides of each of a pair of clamped racks, and being manipulated so that the hooks engage the clamps.

* * * * *